US008298477B2

(12) United States Patent
Marmann

(10) Patent No.: US 8,298,477 B2
(45) Date of Patent: Oct. 30, 2012

(54) LANCE HOLDER

(75) Inventor: Horst K. Marmann, Düsseldorf (DE)

(73) Assignee: BEDA Oxygentechnik Armaturen GmbH, Ratingen (DE)

( * ) Notice: Subject to any disclaimer, the term of this patent is extended or adjusted under 35 U.S.C. 154(b) by 162 days.

(21) Appl. No.: 12/736,020

(22) PCT Filed: Feb. 20, 2009

(86) PCT No.: PCT/EP2009/001240

§ 371 (c)(1),
(2), (4) Date: Sep. 2, 2010

(87) PCT Pub. No.: WO2009/109301

PCT Pub. Date: Sep. 11, 2009

(65) Prior Publication Data

US 2011/0001021 A1 Jan. 6, 2011

(30) Foreign Application Priority Data

Mar. 4, 2008 (DE) ..... 10 2008 012 554

(51) Int. Cl.
*C21C 5/46* (2006.01)

(52) U.S. Cl. ..... 266/226; 266/225

(58) Field of Classification Search ..... 266/225, 266/226, 287
See application file for complete search history.

(56) References Cited

U.S. PATENT DOCUMENTS

| | | | | |
|---|---|---|---|---|
| 5,106,061 | A * | 4/1992 | Marmann | 266/225 |
| 2010/0140853 | A1* | 6/2010 | Marmann et al. | 266/287 |
| 2011/0001021 | A1* | 1/2011 | Marmann | 248/74.1 |

* cited by examiner

*Primary Examiner* — Scott Kastler
(74) *Attorney, Agent, or Firm* — James Creighton Wray

(57) ABSTRACT

A lance holder characterized by a high degree of safety is equipped with a mounting or a pipe fixing, which safely prevents a rotation even of a bent lance pipe in the lance holder. The clamping head has a fixing part and a clamping part which ensure a punctiform fixation by way of displaceable pressure elements, particularly in the form of spheres. At least three such spheres are disposed across the circumference in a distributed manner, and ensure the safe fixation across a large tolerance range with regard to the dimensions of lance pipes. Said large tolerance region is further secured in that sealing sleeves having a larger inside diameter may be used, since the same are no longer deformed in the longitudinal direction in order to provide the seal, but instead are deformed in the radial direction. In summary the high degree of operational safety is also completed by the association of a chip and/or attachment of a nanocoating.

20 Claims, 1 Drawing Sheet

LANCE HOLDER

This application claims the benefit of German Application No. 10 2008 012 554.7 filed Mar. 4, 2008 and PCT/EP2009/001240 filed Feb. 20, 2009, which are hereby incorporated by reference in their entirety as if fully set forth herein.

The invention concerns a lance holder, particularly for lance tubes used in the iron and steel industry, in particular with a clamping head which has a fixing part and a clamping part which can slipped onto it, the clamping part being assigned to a sealing sleeve which clamps and thus seals the introduced lance tube, which can be influenced over the fixing part. Such a lance holder can also have a backburn safety device, for example with a sintered metal or a thermal element and/or a non-return valve located downstream.

Lance holders with a clamping head, in particular those fitted with a slag non-return safety device or backburn safety device serve to securely hold a lance tube needed, for example, to refine or separate/burn or melt or blow in. The said security devices, on the other hand, serve, for example, to prevent slag from running back to the oxygen inlet when the blasting process is completed or interrupted.

According to DE 23 27 595C, a gas-permeable sintered metal disc, which prevents slag return, is arranged shortly before the oxygen hose. This mechanical barrier to slag return does not always fulfil requirements, particularly if high volumes of oxygen have to flow through, because then a sintered metal disc naturally leads to difficulties. The upstream valve arrangement also performs a sort of slag-return prevention function, closing when the gasket arranged above has been burned due to returning slag.

A non-return safety device consisting of valve balls displaceable relative to one another is known from DE 24 47 723 B whereby a valve ball is pressed into the sealing surface by means of a securing device which melts when it comes in contact with the slag in to prevent throughflow of the slag and, at the same time, to also prevent further throughflow of the oxygen.

The lance tube inserted into the lance holder is held by a clamping head with a collet arranged therein. The effect of the teeth of the collet is to hold the lance tube inserted in the lance holder. A sealing sleeve is arranged behind this collet and is affected by the inserted tube and deformed so that it is in close contact with the outside of the lance tube.

This close contact due to deformation of the sealing sleeve has the initial disadvantage that the sealing sleeve may stick to the lance tube, so that the remainder of the lance tube can only be removed with difficulty or by removing the sealing sleeve as well when the collet is opened. This problem and the particular configuration of the collet have the disadvantage that the diameter of the respective lance holder must be quite precisely matched to the diameter of the lance tubes to be inserted and held.

Currently, lance holders are in use which can accept and firmly hold imperial tubes and there are others which can accept metric lance tubes. Only very narrow tolerances are possible due to the movement of the collet and ultimately also the sealing sleeve, usually in the range of about 0.2 mm. Since these lance tubes are consumables, businesses are ultimately forced to purchase them for both imperial and metric tube diameters, causing problems for the work force, because they usually depend on lance holders which accept only a few tube diameters. This means that damage and accidents occur repeatedly, because the lance holder components which are crucial to fixing and sealing are damaged during operation by a tube which has a diameter which is too great or too small, rendering the lance holder unusable.

Since these lance tubes introduce oxygen into the melt and usually have to be curved or bent for this purpose, the molten steel can endanger operators, particularly if the lance tubes slip out or if other problems occur. Even if the operators are protected by protective clothing and hard hats, protection against molten steel is inadequate, so that injuries and detrimental effects can occur repeatedly.

The invention is therefore based on the task of creating a lance holder which is safe to operate and easy to handle for lance pipes simultaneously having as many dimensions as possible.

The problem is solved according to the invention, in that the fixing part is provided with a leading bevel in which at least one pressure element, in particular a plurality of them distributed around the circumference, in particular where at two pressure elements which are not connected with each other are displaceable at right angles to the longitudinal axis of the introduced lance tube which all can be influenced simultaneously over the clamping part which has a pressure bevel, in particular by a movement of the clamping part over the fixing part, for example through turning or sliding, so that the pressure elements can be pressed inwards in a radial direction.

Using a lance holder designed in such way it is first of all possible to hold the inserted lance tube precisely and securely, when operating the clamping head or particularly the clamping part which is pushed onto the fixing part, in particular non-rotatably, in that it is fixed in place over the pressure elements, in particular at a number of locations whose number is the number of the pressure elements. This ensures that once the lance tube is inserted, it can only be removed through deliberate operation of the clamping part.

The lance tube is securely held throughout the whole series of operations, the sealing sleeve being protected against sticking by further optional measures described below and itself having a diameter which allows the use of lance tubes of different diameters. The area covered by different lance tube diameters is restricted by the leading bevel and the correspondingly designed clamping part, whereby a considerable reduction in the sizes of the lance holder is possible. The tolerance range is increased to approximately 0.5-3.00 mm by the design according to the invention, depending upon the structure of the lance holder. In this way the number of lance tubes currently in use, for which previously a variety of lance holders, tailor-made to the respective dimensions were necessary, can be reduced to six or seven. This is rendered possible because the displaceable pressure elements act and take effect as soon as lance tubes of the sizes intended for the respective lance holder are inserted, whilst fixing a lance tube with a smaller external circumference still remains possible because the displaceable pressure elements then only take effect after a corresponding displacement path and fix the lance tube in place.

A convenient embodiment provides for the pressure elements being formed so as to at least primarily exert a punctiform or linear loading pressure on the introduced lance pipe. Pressure elements are thus used which do not exercise pressure across the surface of the lance tube, but punctiform or linearly, so that a higher, more targeted pressure or load pressure can be generated. The design can be selected, in this case, in such a way that the pressure elements cause local elastic or plastic deformation in the peripheral surface of the lance pipe whereby not only a force-locking connection or a friction connection of the pressure elements can be achieved through the deformation but also a form-locking connection.

It is preferable to use cylindrical pins, for example, as pressure elements with at least one side having a pointed, cutter type or spherical end or balls.

A particularly purposeful embodiment provides for the pressure elements being formed as balls so that the aforementioned punctiform load pressure can be generated, in particular whereby the lance tubes usually consisting of mild steel, e.g. ST 37 whilst the balls are made of a hardened material, thus ensuring a long lifetime.

Particularly even and secure fixing of the lance tubes in the lance holder is provided if at least three balls are evenly distributed around the circumference, guided in the leading bevel of the fixing part. There are appropriate bores present in the leading bevel through which the respective ball can be pressed onto the surface of the lance tube by the pushed on or displaced clamping part. For this purpose, the clamping part has, as aforementioned, a corresponding pressure bevel which extends uniformly, ensuring that at least one ball, but preferably all balls, can be moved towards the inserted lance tube in their bores simultaneously, to hold the inserted lance tube securely and to fix it permanently in place. The said bore holes can be designed in such a way that they each have a free inner area in which a ball can be moved freely where at least the mouth area of the bore hole pointing towards a lance pipe or towards the inside of the fixing part, has a projection pointing inwards in the bore hole, for example a protruding peripheral collar, which reduces the diameter of the bore hole at its mouth area to a dimension smaller than the diameter of the ball so that a ball is very firmly located in the fixing part. A similar acting projection or collar can also be formed at the opening to the leading bevel. Thus a fixing part can form a ball cage in which the balls have a restricted freedom of movement. Such a projection can, for example, also have been created during manufacture of the fixing part after inserting the balls through local plastic deformation.

It has already been stated above that for this invention, in a possible embodiment, it is possible to dispense with lengthwise deformation of the sealing sleeve to prevent it from sticking. To do this, use is made of a sealing sleeve with a larger diameter than lance pipes to be used, the fixing part according to the invention in this embodiment having a wedge insertable between the external wall of the sealing sleeve and the surrounding protective casing. Said wedge acts on the sealing sleeve and ensures that the latter is in sufficiently close contact with the external wall of the lance tube, ensuring a secure seal. If the fixing part and its wedge are withdrawn on release, the sealing sleeve will be relieved, can regain its shape and separate from the rest of the lance tube, so that the lance tube can be removed from the lance holder easily. The sealing sleeve is no longer deformed in its longitudinal axis but is pushed by the wedge in a targeted fashion onto the lance pipe to be held and sealed, in particular at least primarily in a radial direction.

Displacement of the clamping part on to the fixing part purposefully takes place by the clamping part of the clamping head having a clamping sleeve which encloses the clamping part and which can be displaced on the external thread of the protective casing and is fitted with a ball bearing located between the front wall of the side part and the clamping wall of the clamping sleeve. The ball bearing located between the clamping sleeve and the clamping part reduces the friction arising from movement of the clamping part. Thus, through the use of only little force it is possible to appropriately push the clamping part onto the fixing part and to influence the pressure elements, particularly the balls, and to press them against the pipe wall.

This process takes place simply by turning the clamping sleeve, which may be further facilitated by roughened contact surfaces and the like. The lance tube must be inserted far enough into the lance holder, i.e. through the sealing sleeve, in particular right up to the stop. In order particularly to ensure this occurs it is possible to provide a control valve which blocks off the gas stream between the sealing sleeve and a backburn safety device, with a lance pipe stop and a non-return valve on the other side of the backburn safety device in a protective housing which can be actuated by the gas stream or can respond to it. Operation therefore cannot commence when the lance tube has been inserted in the lance holder until it has been inserted far enough and the control valve has freed up the line. The gas stream, in particular the oxygen stream, is free to flow which opens the non-return valve so that now the gas stream or the oxygen stream can flow throughout the whole protective housing of the lance holder and then through the lance pipe.

In order to make it possible to install and maintain the parts downstream of the lance holder itself separately, the invention also, in a preferred further embodiment, provides for a safety body (backburn safety device) to be located in the direction of flow upstream of the lance holder which can include a non-return valve, a thermal safety device and a control valve. The safety body can be a single piece with the lance holder or screwed together with it as a separate part.

It has already been stated above that the number of sizes required can be reduced considerably by the lance holder according to the invention. According to the invention provision is made in a possible further embodiment for the fixing part, clamping part and sealing sleeve to be formed having tube tolerances of 3-4 mm for group dimensions which accommodate both metric and imperial tubes. This makes it possible, as already mentioned above, to cover requirements through use of about seven or less holder sizes, whilst currently far more than 15 such holder sizes have to be considered in order to make fairly reliable lance holder operation possible.

It is purposeful to perform maintenance on every type of lance holder but also usually legally prescribed on safety grounds. Another aspect of the invention makes provision to allow the service intervals to be observed exactly and also to ensure correct operation where there are changes in the operating personnel in that every type of lance holder, in particular those according the invention, is fitted with a chip suitable for storing data, e.g. an RFID chip. For example, in the case of a single part design, a chip suitable for storing data can be assigned to the partial enclosure for the closure piston for the non-return valve or, in a multiple part design, a chip assigned to each protective housing. This chip is preferably designed in such a way or provided with information in such a way that this information can be retrieved as required in order, amongst other things, to be able to call up both the construction type the first time it was used as well as the total number of operating hours to-date.

Known chips are usually not usable in smelting works and steel works because of the high temperatures involved but also because of other stresses which arise. In order to also secure their use in these areas the invention also makes provision for a further embodiment where the chip is contained in a metal housing which has a thread on the side, that is in particular a metal housing with an external thread, which corresponds with the internal thread of a bore hole located in a partial enclosure or a protective housing. This housing, which is protected from external influences, can also still be housed in a purposeful way in such a manner that it can both be safely read out but is also practically not negatively effected by external influences. Screwing in of a chip into an appropriate bore hole does not take long and allows one to locate the chip wherever it can be best read out and where it can be best and most safely accommodated. The chip can also be replaced.

In order to avoid the data stored in the chip becoming unreadable due to external influences or a situation, for example, where it cannot be retrieved, the invention makes provision in a further preferred embodiment for the chip to be fitted with a battery-free transponder which can be addressed and activated over the reading equipment. This transponder is fitted with an appropriate antenna and ensures that the required energy can be provided by the reading device in order for the saved data and information to be retrieved and evaluated over the reading device or the reading equipment.

Identification of the chip is simplified in a further preferred embodiment by appropriately marking the metal housing with the transponder on its visible side whereby there is also conveniently a notch present over which screwing of the metal housing into the associated bore hole is made easier. The marking on the visible side makes it easier for the user to find the chip, to activate the transponder and to retrieve the respective data.

Every type of lance holder must be delivered grease-free to the smelting works or the steel works. There is the problem, however, that grease finds its way onto the lance holder housing after relatively short operating times over the gloves worn by the operating personnel or through other influences. There is therefore a risk associated with the possibility of grease or other components tending to ignite which would endanger the workforce.

According to another aspect of the invention this is effectively prevented for all kinds of lance holders, particularly also those made according to the above-mentioned invention (s), in that their housing, in particular the protective housing and also the partial enclosure as well the turning ring, have a continuous nanocoating. Provision of this nanocoating ensures that any retrospectively occurring harmful substance components or grease components arriving on the surface of the respective lance holder protective housing cannot settle or attach itself. They are simply repelled and this therefore ensures that the lance holder always remains free of such harmful substance components or holds itself free.

According to a purposeful further embodiment provision is made that the nanocoating can also be applied to cover the roughened surfaces, for example vapour deposited, the vapour depositing ensures that an adequately thick nanocoating covers all of the areas to be protected. Although there are more costs involved in applying the nanocoating the effect obtained is very significant and is also, in particular, a step ensuring greater safety.

Secure application of the nanocoating on conventional lance holders or those described here according to this invention and permanent attachment thereof can be achieved, preferably, according to the invention, by ensuring that the gripping surfaces and the whole surface of the lance holder, in particular of the protective housing, partial enclosure and turning ring, are thoroughly cleaned before vapour depositing, preferably through using ultrasound cleaning equipment. The nanocoating is applied to a clean surface after the appropriate cleaning so that an overall protected lance holder can be made available.

Additional protection for the backburn safety device provided is achieved according to the invention in a further embodiment in that the backburn safety device or the slag non-return safety device has a valve disc located upstream of them which is formed to be moved with the introduced lance pipe against the force of a spring. This valve disc represents additional security which can be advantageous in particularly difficult areas of operation.

It has already been stated above that the lance holder in its preferred embodiment can only be brought into operation if the lance pipe has been introduced far enough into the lance holder. The control valve is then opened at the same time as sufficient introduction of the lance pipe has occurred which can particularly ensure that the lance pipe stop is assigned to a push sleeve which tapers inwards in the middle and then broadens again to the control valve to effect the latter. This special form offers the possibility of designing the lance pipe stop to be adequately stable, also for pipes with differing diameters, and therefore to ensure that it is always moved in such a way that the control valve located behind it opens or also is closed for a movement in the opposite direction.

Excessively wide opening of this control valve through excessively large movement of the push sleeve is prevented in that the push sleeve is located and designed to be movable when inserting the lance pipe against a safety stop for the protective housing. The optimal position, which can be recognised as such by the user, is achieved upon reaching the safety stop so the user does not need to continue to try to push the lance pipe into the lance holder. Even if he would try to do this the safety stop ensures that damage cannot occur to the lance pipe stop with the push sleeve.

The invention is particularly characterised by the creation of a lance holder which can be used in both the iron and steel industries without any unnecessary potential hazard to the operators through mishandling or operation of the lance holder, or due to inadmissible lance tube diameters. Firstly, the lance tube inserted in the lance holder is optimally fixed therein, simultaneously ensuring that the lance tube is always inserted far enough into the lance holder during operation, that is as far as the stop. In the preferred embodiment when the stop is reached, or shortly before this, during clamping, the non-return valve blocking the inflow of gas is opened and the gas can flow through the lance holder into the lance tube previously held in the sealed lance tube.

The necessary sealing of the lance tube no longer takes place in the preferred embodiment by means of a sealing sleeve deformed longitudinally, but by the sealing sleeve being pressed evenly and securely against the respective lance tube by a wedge, in particular one which is located at the inner end of the fixing part. This wedge can be designed as a pipe end which has a reducing wall thickness, in particular at the inner end of the fixing part, which has a larger diameter than the freely passable area for the lance pipe, in particular in such a way that its external diameter is equal to or greater than the external diameter of the sealing sleeve. This offers the possibility of using sealing sleeves with a larger diameter than the external diameter of the lance pipes. The purposeful design of the clamping head with pressure elements, in particular in the form of balls displaceable at right angles to the longitudinal axis, primarily ensures punctiform application of the load pressure and thus optimal fixing of the lance tubes inside the lance holder. This ensures that the lance tube cannot rotate in the lance holder, whereby the lance holder is fixed by the clamping head and the sealing sleeve, but so securely by the clamping head that any detrimental effect whatsoever on the fixing of the lance tube is precluded. Introduction of the oxygen in the lance pipes hidden in the liquid melt can be secured in this way and there can be no further danger presented by turning away lance pipes.

Further advantages are associated with the assigned chip and the nanocoating, in particular as concerns safety. Depending on the design used the new lance holder allows one to use lance pipes with different diameters using the one and the same lance holder. It is possible to operate safely with pipe tolerances of 3-4 mm. The lance pipes can be removed easily. The sealing sleeves do not tend anymore to have material sticking to then.

It is further advantageous, in an additional embodiment that the oxygen cannot flow if the lance pipe has not been introduced right down to the stop. The lance holder has a considerably reduced overall weight and a very compact design. The clamping head is hardened and can have a long useful life. It is also advantageous that the lance holder 1 can be assembled and dismantled easily and, as already mentioned, can be fitted with a chip which contains various information and data. An optimal oxygen throughput is possible through appropriate design of the downstream components.

A preferred backburn safety device can be used for the widest possible range of lance holders. It is only necessary to have a special size for lance holders for pipes of 23 to 26 and 26 to 29 mm. This backburn safety device is advantageously safely located and can no longer be damaged by the inserted lance pipe.

Further details and advantages of the subject of the invention can be taken from the following description of the relevant drawing, which shows a preferred specimen embodiment with the necessary details and individual components. It shows:

DETAILED DESCRIPTION OF THE PREFERRED EMBODIMENTS

Figure 1:
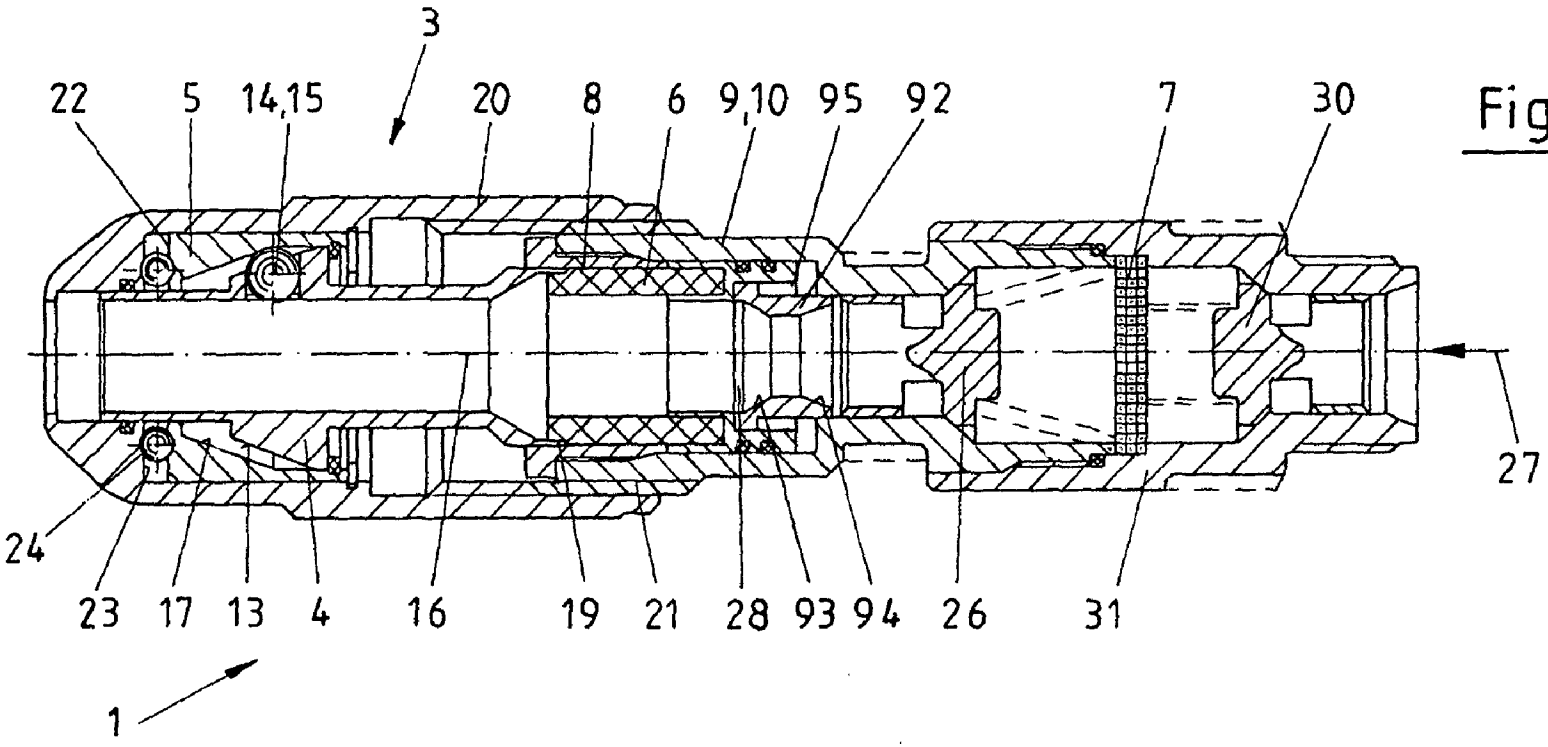
FIG. 1 a lance holder according to the invention,
FIG. 2 a view from above of a chip.
Figure 2:
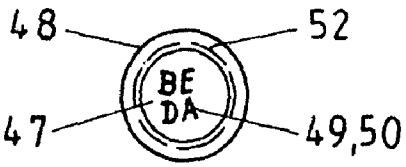

FIG. 1 a cross-sectional view of a lance holder 1. A lance tube (not shown) can be inserted into this lance holder to be held firmly in it. The firm holding takes place over the clamping head 3 which consists here of a fixing part 4 and a clamping part 5. This clamping head 3 is located after a sealing sleeve 6 which can be designed or deformed in such a way that it seals tightly around the introduced lance pipe and ensures that the introduced gas (gas stream 27) flows precisely through the lance holder 1 without allowing any leaks.

There is a backburn safety device 7 housed in a protective housing 9 or 10 behind the sealing sleeve 6 which is basically a known backburn safety device 7.

The clamping head 3 includes the fixing part 4 with a leading bevel 13 in which the pressure elements 14 are housed in the form of balls 15. A preferred number of three such balls 15 are distributed over the circumference which are located in bore holes in the leading bevel 13 so that they can move at right angles to the longitudinal axis 16 of the lance holder 1. This movement takes place over the clamping part 5 which is fitted, to do this, with a pressure bevel 17. Through moving these pressure bevels 17 in the direction of the sealing sleeve 6 the balls 15 are influenced in such a way that they press in a punctiform fashion onto the introduced lance pipe and thus ensure that the lance pipe is fully fixed in place and also located so as to prevent rotation in the lance holder 1. Sliding of the clamping part 5 onto the fixing 4 also causes an appropriate movement of the fixing part 4 in the direction of the sealing sleeve 6. The fact that the fixing part 4 is fitted with a wedge 19 at its inner end means that this is appropriately pushed in-between the protective housing 9, 10 and the external wall 8 of the sealing sleeve 6 whereby the sealing sleeve 6, which has an appropriately thick wall, is pressed onto the external wall 8 of the lance pipe and seals here due to the pressing on effect in the direction on the lance pipe, whereby adherence onto the lance pipe is precluded with a high degree of certainty since at least no significant deformation of the sealing sleeve 6 takes place in a longitudinal direction. It is furthermore advantageous that, in this case, sealing sleeves 6 with a large internal diameter can be used so that also lance pipes of different diameters can be used and sealed, naturally only those which are within the prescribed tolerances.

Moving of the clamping part 5 or its pressure bevel 17 takes place over a clamping sleeve 20 which can be rotated at the external thread 21 of the protective housing 9 and is therefore movable. This moving action takes place easily and evenly because a ball bearing 24 is located between the front wall 22 of the clamping part 5 and the clamping wall 23 of the clamping sleeve 20. As already mentioned, this allows even movement and a reduction in friction.

Introduction of the lance pipe into the lance holder 1 should be secured since it is only when there is a sufficiently introduced lance pipe that the control valve 26 can be opened by the clamping part 5. This introduction is secured through the use of a lance pipe stop 28 which has a special form and is assigned to a push sleeve 92. This push sleeve 92 is fitted with a central ring and bevels 93, 94 so that an overall stable construction is made which, at the same time, also allows use of pipes of different diameters. The push sleeve 92 acts on the edge of the control valve 26 and opens it until the safety stop 15 is reached. Thus further movement of the push sleeve 92 and also further opening of the control valve 26 is prevented.

FIG. 1 shows an arrangement in which the downstream non-return valve 30 is opened by the pressure of the gas stream 27 without an opening valve being shown. This opening can only take place, however, if, as described above, the control valve 26 is opened and the lance pipe is introduced sufficiently deeply.

Regarding the wedge 19, it is important to add that it is not the fixing part 4 with the wedge 19 which is moved but that it is actually the other way round where the whole clamping sleeve 20 moves and ensures that the wedge 19 can be pushed in-between the outside wall 8 of the sealing sleeve 6 and the protective housing 9. Furthermore FIG. 1 shows that the backburn safety device 7 with both the control and the non-return valves 26, 30 are assigned to a separate safety housing 31 in order to simplify maintenance work or other work.

All of the above-mentioned features, also those which can be just taken from the drawings, are considered to be novel, both when taken alone but also when seen in combination with each other.

As concerns all of the embodiments mentioned, one can state that the technical features mentioned in connection with a particular embodiment can not only be implemented, or are implemented, for that specific embodiment but also in all other embodiments. All disclosed technical features in this description of the invention are to be seen as novel and can be combined with each other in any way or can also be used alone. Therefore, within this whole disclosure where there is mention that a feature can be provided or a processing step can be performed, an embodiment of the invention can also be understood in which the feature in question is provided or the appropriate processing step is performed.

The invention claimed is:

1. A lance holder for lance tubes which are particularly used in the iron and steel industry with a clamping head (3) which has a fixing part (4) and a clamping part (5) which can be moved on it, the clamping part (5) being assigned to a sealing sleeve (6) which can be influenced over the fixing part (4), which clamps and thus seals an introduced lance pipe, with a backburn safety device (7) and/or a non-return valve being located downstream, wherein the fixing part (4) is provided with a leading bevel (13) in which at least one pressure element, with at least two individual movable pressure elements (14) distributed around the circumference located at right angles to the longitudinal axis (16) of the lance tube (2) which can all simultaneously be influenced over a clamping part (5) having a pressure bevel (17), which are displaceable radially inwards.

2. A lance holder according to claim 1, wherein the pressure elements (16) are formed so as to generate a punctiform and/or linear pressure load on the introduced lance pipe.

3. A lance holder according to claim 1, wherein the pressure elements (14) are formed as a cylindrical pin with at least a pointed, cutter type or spherical end or as balls (15).

4. A lance holder according to claim 1, wherein at least three pressure elements, are balls (15) and are arranged guided in the leading bevels (13) of the fixing part (4), evenly distributed around the circumference of the lance tube.

5. A lance holder according to claim 1, wherein that the fixing part (4) has a movable wedge (19) between the outside wall (8) of the sealing sleeve (6) and a surrounding protective housing (9).

6. A lance holder according to claim 1, wherein the clamping part (5) of the clamping head (3) has a clamping sleeve (20) which is formed so as to enclose the clamping part (5) and to be displaceable on an external thread (21) of a protective casing (9) and which is fitted with a ball bearing (24) located between a front wall (22) of the clamping part (5) and a clamping wall (23) of a clamping sleeve (20).

7. A lance holder according to claim 1, wherein there is a non-return valve (25) with lance pipe stop (28) located between the sealing sleeve (6) and backburn safety device (7) which shuts off the gas stream (27) and, on the other side of the backburn safety device (7), a non-return valve (30) in a protective housing (9) which can be actuated by or is responsive to a gas stream (27).

8. A lance holder according to claim 7, wherein a backburn safety device (7) with the non-return valves (26, 30) is inside a safety housing (31) which can be attached to a detachable protective housing (9).

9. A lance holder according to claim 1, wherein the fixing part (4), clamping part (5) and sealing sleeve (6) are formed with tube tolerances of 3-4 mm for group dimensions which can accommodate both metric and imperial tubes.

10. A lance holder according to claim 1, wherein a chip suitable for storing data inside a housing or a part of the housing of the lance holder.

11. A lance holder according to claim 10, wherein in the case of a single part design a chip (47) suitable for storing data can be assigned to a partial enclosure (45) for a closure piston (34) for a non-return valve (26) or, in a multiple part design a chip (47) can be assigned to each of a plurality of protective housings (9, 10, 31, 45).

12. A lance holder according to claim 10 wherein, the chip (47) is contained in a metal housing (48) which has a thread (52) on the side which corresponds with the internal thread (56) of a bore hole (51) in the housing of a partial enclosure (45) or a protective housing (9, 10).

13. A lance holder according to claim 10 wherein the chip (47) is fitted with a battery-free transponder which can be addressed and activated over reading equipment.

14. A lance holder according to claim 12, wherein the metal housing (48) with a transponder is marked on a visible side (49) with a marking (50).

15. The lance holder according to claim 1, wherein that a protective housing (9, 10) and/or attachments on the housing and also a partial enclosure (31, 45) have a continuous grease-rejecting, nanocoating (53).

16. A lance holder according to claim 15, wherein the nanocoating (53) is also applied to cover roughened surfaces (54) through vapour depositing.

17. A lance holder according to claim 1, wherein a lever protection system (88) in the form of a dead man switch is located between a backburn safety device (7) and a non-return valve (30) which can be actuated by a gas stream (27) whereby an articulated operating lever (89) for actuating the non-return valve (30) is fitted with a spring for automatic return of the operating lever (89) into the closed position.

18. A lance holder according to claim 1, wherein a backburn safety device (7) or slag non-return safety device has a valve disc pre-positioned in front of it which is designed to be moved with the introduced lance pipe (2) against the force of a spring.

19. A lance holder according to claim 1, wherein a lance pipe stop (28) is inside a push sleeve (92), wherein the push sleeve (92) tapers inwards in the middle and then broadens again to the non-return valve (26).

20. The lance holder according to claim 1, wherein a push sleeve (92) is located and designed to be movable when inserting the lance pipe against a safety stop (95) of a protective housing (9, 10) when inserting the lance pipe (2).

* * * * *